US005652566A

United States Patent [19]

Lambert

[11] Patent Number: 5,652,566

[45] Date of Patent: Jul. 29, 1997

[54] ALARM SYSTEM

[75] Inventor: Scott Anthony Lambert, East Bethel, Minn.

[73] Assignee: Aequitron Medical, Inc., Minneapolis, Minn.

[21] Appl. No.: 573,442

[22] Filed: Dec. 15, 1995

[51] Int. Cl.[6] ..... G08B 29/00; H04R 29/00

[52] U.S. Cl. ..... 340/507; 340/506; 340/508; 340/514; 340/692; 367/199; 381/58; 381/59; 381/85

[58] Field of Search ..... 340/507, 506, 340/508, 514, 515, 692, 286, 11; 367/197–199; 381/58, 56, 59, 84, 85, 82

[56] References Cited

U.S. PATENT DOCUMENTS

| | | | |
|---|---|---|---|
| 3,641,570 | 2/1972 | Thompson | 340/508 |
| 3,656,158 | 4/1972 | Goodwater . | |
| 3,893,092 | 7/1975 | Kessler | 340/502 |
| 3,989,908 | 11/1976 | Budrys et al. . | |
| 4,012,728 | 3/1977 | Fowler | 340/539 |
| 4,037,222 | 7/1977 | Solomon . | |
| 4,241,335 | 12/1980 | Barnes | 340/507 |
| 4,803,465 | 2/1989 | Prysby | 340/507 |
| 5,103,206 | 4/1992 | Yu | 340/506 |
| 5,345,510 | 9/1994 | Singhi et al. | 381/77 |
| 5,361,305 | 11/1994 | Easley et al. | 381/58 |
| 5,574,437 | 11/1996 | Schwinn et al. | 340/507 |

*Primary Examiner*—Donnie L. Crosland

*Attorney, Agent, or Firm*—Merchant, Gould, Smith, Edell, Welter & Schmidt, P.A.

[57] ABSTRACT

A redundant alarm system including a central controller that interfaces with a first alarm, a second alarm, a visual indicator and an acoustic sensor. When an alarm condition exists, the controller activates the primary alarm causing the primary alarm to generate an audible first alarm signal. The audible first alarm signal is transmitted from the primary alarm to the acoustical sensor. The acoustical sensor detects the audible first alarm signal and transduces the audible first alarm signal into a first feedback signal that is relayed to the controller. If the controller does not receive the first feedback signal from the acoustical sensor within a predetermined time after activating the primary alarm, the controller activates the secondary alarm and the visual indicator.

9 Claims, 3 Drawing Sheets

ALARM SYSTEM

FIELD OF THE INVENTION

The present invention relates generally to alarm systems. Specifically, the present invention relates to redundant alarm systems.

BACKGROUND OF THE INVENTION

Reliability is a critical requirement for effective alarm systems. For example, in a hospital, a patient's life often depends on the effective operation of a medical monitor alarm. Therefore, medical monitoring devices represent one important field of use where alarm reliability is critical.

Various redundant alarm systems have been developed to increase alarm reliability. For example, most redundant alarm systems employ dual alarms that operate concurrently. Because such systems employ at least two alarms, if one of the alarms fails, the other alarm will still function to transmit an alarm signal. However, such redundant alarm systems typically do not include a feedback mechanism for indicating when one of the alarms is inoperative. Because the systems lack a feedback mechanism, the failure of one of the alarms may go undetected for extended periods of time. Therefore, such concurrently operating redundant alarm systems may yield a reliability equal to that of a single alarm system.

Other redundant alarm systems have employed a feedback mechanism for indicating when one of the redundant alarms is inoperative. These alarm systems sense the electric current provided to the alarms and detect when the current is interrupted. Although such alarm systems provide improved reliability as compared to concurrently operating redundant alarms, they may not detect all alarm failures. For example, when an alarm is operating at a harmonic of the fundamental operating frequency, the alarm may still draw current and may be inaudible. Such an alarm failure would not be detected by electric current based feedback mechanisms.

SUMMARY OF THE INVENTION

The present invention relates to a redundant alarm system having increased reliability as compared to known alarm systems. The redundant alarm system of the present invention includes a central controller for processing information. The central controller interfaces with an audible first alarm, a second alarm and an acoustic sensor. When an alarm condition exists, the controller sends a first power-on signal to the primary alarm. The first power-on signal activates the primary alarm causing the primary alarm to generate an audible first alarm signal having a predetermined frequency. The audible first alarm signal is transmitted from the primary alarm to the acoustical sensor. The acoustical sensor detects the audible first alarm signal and transduces the audible first alarm signal into a first feedback signal that is relayed to the controller. If the controller does not receive the first feedback signal from the acoustical sensor within a predetermined time after transmitting the first power-on signal to the primary alarm, the controller sends a second power-on signal to the secondary alarm. The second power-on signal activates the secondary alarm causing the secondary alarm to generate a second alarm signal. In this manner, the secondary alarm functions as a back up for the inoperative primary alarm. If the controller does receive the first feedback signal from the acoustical sensor within a predetermined time after transmitting the first power-on signal to the primary alarm, the secondary alarm is not activated.

In certain embodiments of the present invention, a visual indicator is activated concurrently with the secondary alarm to indicate that the primary alarm has failed.

The above-described invention provides a redundant alarm system having an improved feedback system as compared to the prior art. Unlike prior art systems, the above-described invention uses an acoustic sensor to monitor whether the primary alarm is transmitting an audible alarm signal. Therefore, the redundant alarm system of the present invention can detect when the primary alarm fails even if the primary alarm is operating at a harmonic of the fundamental operating frequency.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
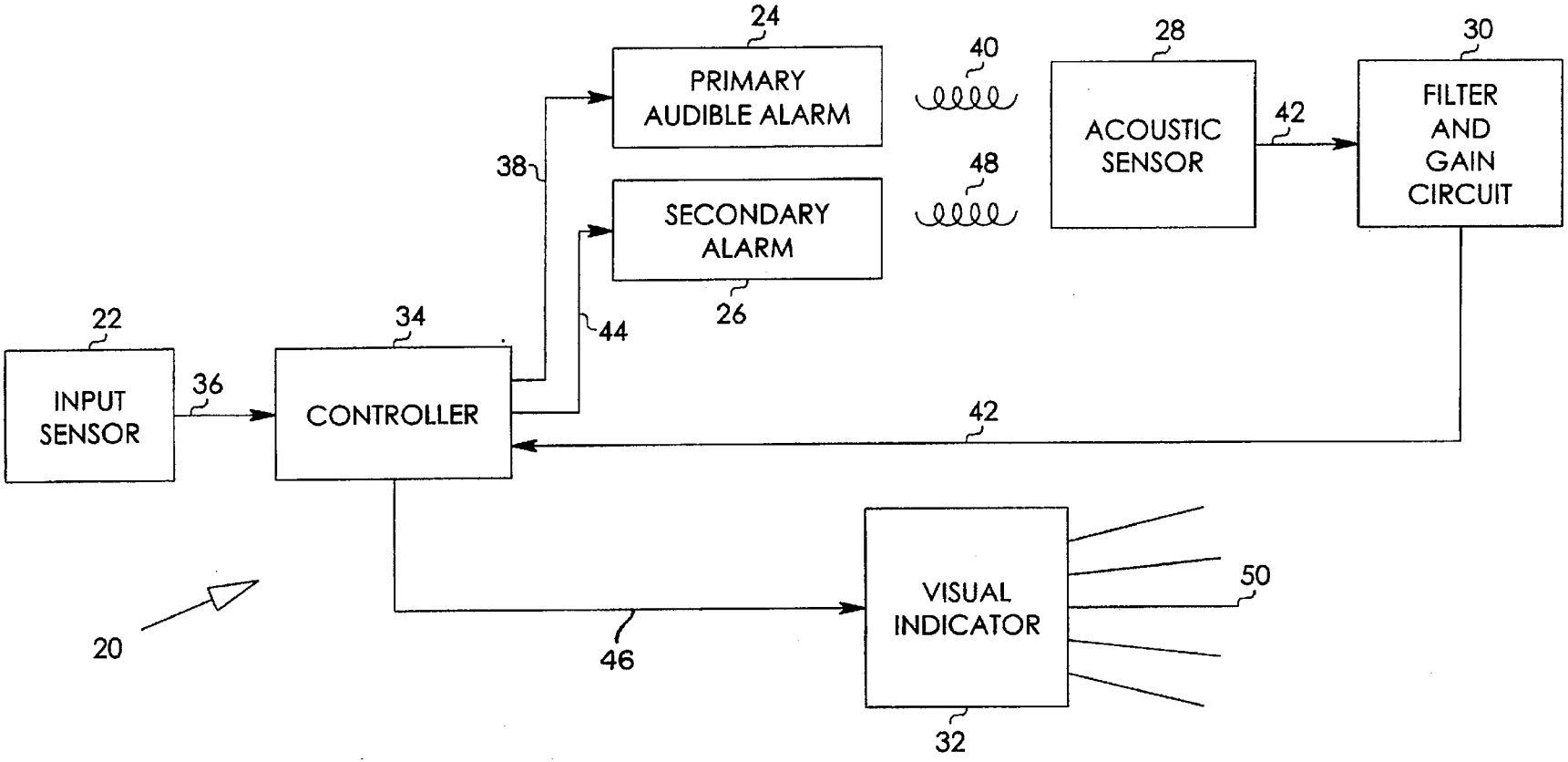
FIG. 1 is a block diagram illustrating a redundant alarm system in accordance with the principles of the present invention.

FIG. 1 is a block diagram illustrating a redundant alarm system 20 in accordance with the principles of the present invention. The redundant alarm system 20 preferably includes a central controller 34 for processing input signals and generating output signals. The central controller 34 interfaces with an input sensor 22, a primary audible alarm 24, a secondary alarm 26, an acoustic sensor 28 and a visual indicator 32. The input sensor 22 provides alarm condition information to the controller 34. When an alarm condition is indicated by the input sensor 22, the controller 34 activates the primary alarm 24. The acoustic sensor 28 detects whether the primary audible alarm 24 is operational and sends feedback information to the controller 34 regarding the operational status of the primary alarm 24. A filter and gain circuit 30 filters out extraneous sounds detected by the acoustic sensor 28. The central controller 34 processes the feedback information provided by the acoustic sensor 28. If the feedback information indicates that the primary alarm is not functioning, the controller 34 preferably concurrently activates the secondary alarm 24 and the visual indicator 32. A more detailed description of the operating sequence of the alarm system 20 is provided in the following paragraphs.

The alarm sequence begins when the input sensor 22 detects an alarm condition and sends an alarm condition signal 36 to the controller 34. Upon receipt of the alarm condition signal 36, the controller 34 transmits a first power-on signal 38 to the primary audible alarm 24. The first power-on signal 38 activates the primary audible alarm 24 causing the primary audible alarm 24 to generate an audible primary alarm signal 40. The acoustic sensor 28 detects the audible primary alarm signal 40 and transduces the audible alarm signal 40 into a feedback signal 42 that passes through the filter and gain circuit 30. The filter and gain circuit 30 filters out extraneous sounds detected by the acoustic sensor and strengthens the feedback signal 42 provided by the acoustic sensor 28.

From the filter and gain circuit 30, the feedback signal 42 is relayed to the controller 34. If the controller 34 does not receive the feedback signal 42 from the acoustical sensor 28 within a predetermined time after transmitting the first power-on signal 38 to the primary alarm 24, the controller 34 preferably concurrently transmits a second power-on signal 44 to the secondary audible alarm 26 and a third power-on signal 46 to the visual indicator 32. The second power-on signal 44 activates the second audible alarm 26 causing the second audible alarm 26 to transmit a second alarm signal 48. Similarly, the third power-on signal 46 activates the visual indicator 32 causing the visual indicator 32 to transmit a visual alarm signal 50. If the controller 34 receives the feedback signal 42 from the acoustic sensor 28, the secondary audible alarm 26 and the visual indicator 32 are not activated by the controller 34.

As indicated in the foregoing description, the secondary alarm 26 and the visual indicator 32 are preferably only activated when the primary alarm 24 fails. In this manner, the secondary alarm 26 functions as a backup alarm to the primary audible alarm 24 and the visual indicator 32 functions to alert a user of the alarm system 20 that the primary audible alarm 24 is inoperative.

It will be appreciated that the redundant alarm system 20 of the present invention may include additional safeguards for improving the reliability of the alarm system. For example, if the secondary alarm 24 is designed to generate an audible alarm signal, the acoustic sensor 28 can be used to monitor whether the secondary audible alarm is functioning in the same manner the acoustic sensor 28 monitors the primary alarm 24. More specifically, if the secondary alarm signal 48 is not detected by the acoustic sensor 28 within a predetermined time after the controller 34 sends the second power-on signal 44 to the secondary audible alarm 26, the controller 34 activates an additional alarm such as another visual indicator or a third audible alarm (not shown) to provide notice that both the primary audible alarm 24 and the secondary audible alarm 26 are inoperative. By using a series audible alarms, with each alarm being individually monitored by the acoustic sensor 28 and only being activated if the preceding alarm fails, the reliability of the alarm system 20 can be further enhanced.

It will be appreciated that redundant acoustic sensors, such as primary and secondary acoustic sensors, can also be used to increase the reliability of the alarm system. For example, if redundant acoustic sensors are used and the primary acoustic sensor fails, a visual indicator is preferably illuminated to indicate the failure of the primary acoustic sensor and the secondary acoustic sensor functions to back-up the primary sensor.

The controller 24 can also be configured to detect when erroneous feed back signals 42 are being generated during non-alarm conditions. Such a situation may occur if one of the primary or secondary alarms 24 and 26 malfunctions and begins to transmit audible alarm signals even though no alarm condition has been sensed by the input sensor 22. The situation may also occur when the acoustic sensor 28 malfunctions and begins to send feedback signals 42 to the controller 34 even though the primary and secondary alarms 24 and 26 have not been activated. When the controller 24 receives a non-alarm condition feedback signal 42 from the acoustic sensor 28, it is preferred for the controller to illuminate the visual indicator 32 so as to provide an indication that there is a malfunction within the system. If an alarm condition is sensed while the visual indicator 32 is illuminated, the controller 24 preferably concurrently activates both the primary and secondary alarms 24 and 26.

As an additional safeguard, it will be appreciated that during power-up of the redundant alarm 20, the primary and secondary audible alarms 24 and 26 can be activated separately to verify that each alarm is operational. Additionally, for certain situations, the feedback system can be deactivated such that the alarm system operates like a conventional redundant alarm and the primary and secondary alarms 24 and 26 are activated concurrently during an alarm condition.

Figure 2:
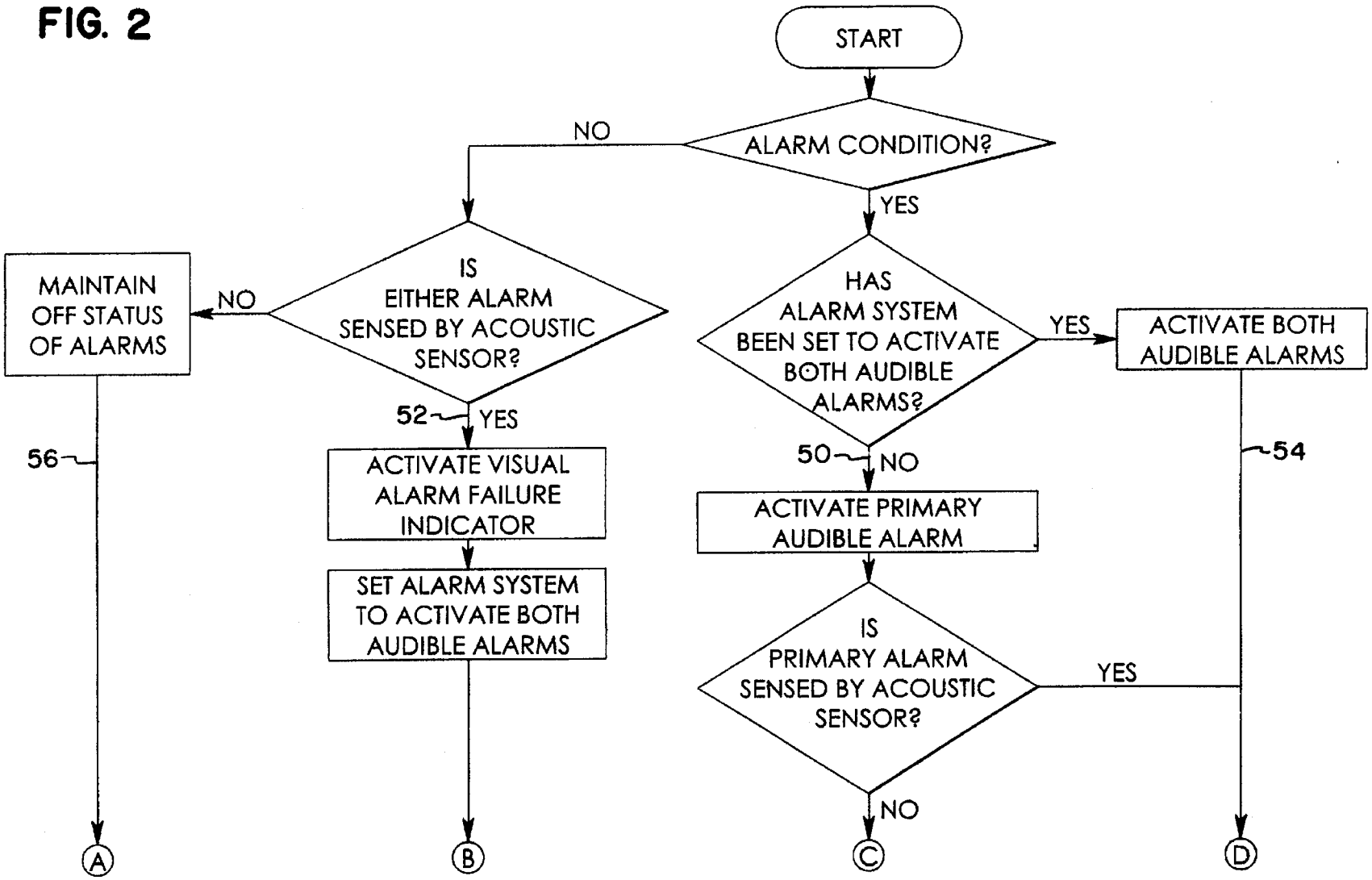
FIGS. 2 and 3 provide a flow chart illustrating control logic employed by a redundant alarm system in accordance with the principles of the present invention.
Figure 3:
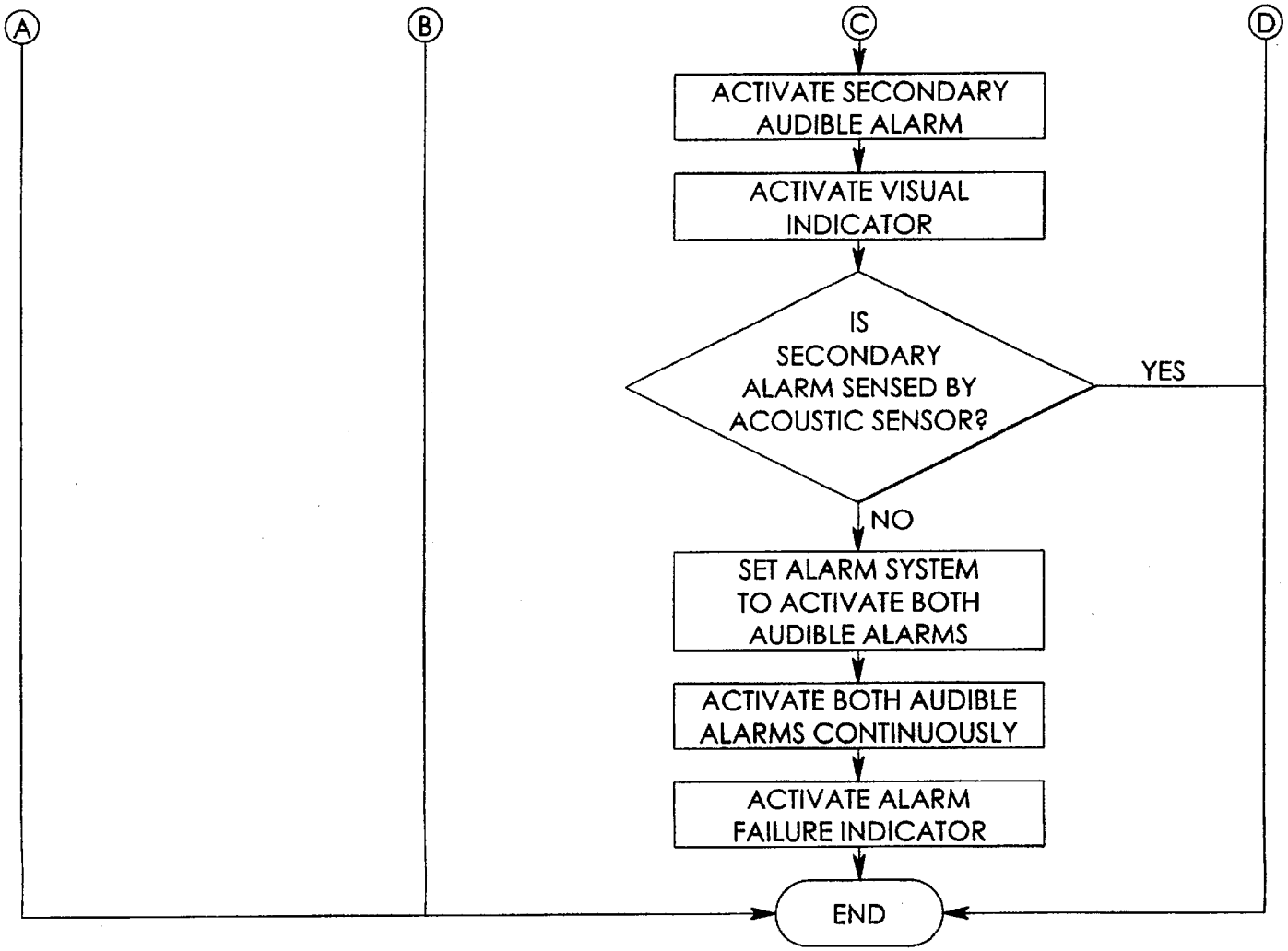

The foregoing description relating to the operation of the redundant alarm system 20 is illustrated in FIGS. 2 and 3 through the use of an alarm systems logic flow chart. A first pathway 50 of the flow chart illustrates the systems control logic for monitoring the operation of the primary alarm 24 and activating the secondary alarm 26 and visual indicator 32 if the primary alarm fails. The first pathway 50 also shows that the acoustic sensor 28 monitors the operation and/or failure of both the primary and secondary alarms 24 and 26. A second pathway 52 of the flow chart shows systems control logic for detecting erroneous feedback signals 42 caused by non-alarm condition malfunctions of the redundant alarm system 20 and activating the primary alarm 24, the secondary alarm 26, and the visual indicator 32. A third pathway 54 of the flow chart shows that the alarm system 20 can be set to concurrently activate both the primary and secondary alarms 24 and 26 such that the alarm system 20 operates like a conventional redundant alarm system. A fourth pathway 56 shows that the alarms 24 and 26 remain off if no alarm condition exists and if no erroneous feedback signals 42 are received by the controller 24.

Due to the reliability of the above-described alarm system, the redundant alarm system is ideally suited for incorporation within a medical monitoring system. However, it will be appreciated that the alarm system 20 can be used any type of alarm conditions and is not limited to the field of medical monitoring devices. The following paragraphs describe in greater detail the preferred functional components employed by the alarm system 20.

It will be apparent to those skilled in the art that the redundant alarm system 20 of the present invention may be powered by a variety of conventional techniques. For example, the alarm system 20 can be connected to a conventional AC power source. Additionally, the redundant alarm system 20 may include a rechargeable battery pack for providing DC current to provide power for operation of the redundant alarm system 20 when the AC power is not connected.

The input sensor 22 of the redundant alarm system 20 may include a variety of conventionally known and manufactured sensors. For example, for use in a medical monitoring device, the input sensor 22 may comprise a variety of physiologic sensing devices. One type of physiologic sensor comprises a pair of electrodes applied to opposite sides of a patient's thorax for monitoring a the patient's heart rate. If the patient's heart rate falls below a certain level or rises above a certain level, the physiologic sensor alerts the controller 34 that the patient is experiencing a physiologic alarm condition such as a bradycardia event or a tachycardia event. Another type of physiologic sensor measures a patient's respiratory effort by injecting constant current between two electrodes placed across the patient's thorax and measuring the impedance change caused by the expansion and contraction of the patient's chest during respiration. When a patient experiences a respiratory physiologic alarm condition such as an apnea event, the thoracic impedance sensors signal the controller 34 to activate the alarm system. Other physiologic sensors monitor the level of oxygen saturation of a patient's blood. When a patient experiences a physiologic alarm condition such as a low blood oxygen level, the sensor signals the controller 34 to activate the alarm system.

Alternative types of input sensors include equipment sensors for monitoring the functionality of the component parts of the alarm system. For example, one type of equipment sensor measures the power level in the batteries used to drive the alarm system. An alarm condition exists when the batteries fall below a certain level. Similarly, another type of equipment sensor that may be employed in a medical monitoring device is a loose lead sensor that senses when electrodes applied to a patient for measuring heart and respiration rates are improperly or loosely connected to the patient.

It will be appreciated by those skilled in the art that the input sensor 22 shall incorporate circuitry for allowing the input sensor 22 to effectively interface with the controller 34. For example, the input sensor 22 may incorporate circuitry to convert analog signals to a digital format that can be processed by the controller The central controller 34 of the alarm system 20 can include any number of conventionally known controlling devices. For example, the controller 34 may include a code driven microprocessing unit or microcontroller. Additionally, the controller 34 can include a special function circuit adapted for mechanically processing input information provided by the input sensor 22 and the acoustic sensor 28 and for sending output signals to the primary alarm 24, the secondary alarm 26 and the visual indicator 32. A preferred controller 34 incorporates a microcontroller which processes software instructions that are programmed in Read Only Memory (ROM) and that interfaces with the input sensor 22, the primary and secondary audible alarms 24 and 26, the acoustic sensor 28, and the visual indicator 32. For use in a medical monitoring device, an exemplary controller is manufactured by NEC and has Model No. 78K233.

The primary and secondary audible alarms 24 and 26 of the redundant alarm system 20 preferably incorporate alarm drive circuitry for allowing the controller 34 to control the on/off status of each of the primary and secondary audible alarms 24 and 26. Each of the primary and secondary audible alarms 24 and 26 also preferably includes a transducer for respectively generating the primary audible alarm signal 40 and the secondary audible alarm signal 48. Where possible, the alarm circuits and transducers of the primary and secondary audible alarms 24 and 26 should not use common components or power sources.

It is preferred for the primary audible alarm signal 40 and the secondary audible alarm signal 48 have a predetermined frequency that is compatible the pass frequency of the filter 30. In this manner, the signals 40 and 48 will be converted into a feedback signal 42 having a frequency within the frequency band range of the filter 30. This enables the feedback signal to pass through the filter 30 and be relayed to the controller 34.

For use in a medical monitoring device, a preferred alarm to be used as primary and secondary audible alarms 24 and 26 is a Mallory "Sonalert" 616 audible alarm. Such alarms have a minimum output of 85 decibels at a distance of one meter from the alarm and have an operating frequency of around 3200 plus or minus 500 hertz. Although it is preferred for the secondary alarm 26 to transmit an audible alarm signal, it will be appreciated that the secondary alarm can generate other types of alarm signals such as visual displays.

The acoustic sensor 28 of the alarm system 20 is preferably a conventional transducer for converting the audible primary alarm signal 40 into the feedback signal 42. A preferred acoustic sensor 28 for use in a medical monitoring device is a Panasonic microphone having Model No. WM-034BY.

The filter and gain circuit 30 of the redundant alarm system 20 is used to filter out signals corresponding to extraneous sounds detected by the acoustic sensor 28. The filter and gain circuit also clarifies and strengthens the feedback signal 42. The feedback signals 42 corresponding to the primary and secondary alarm signals 40 and 48 have a frequency that is within the frequency pass range of the filter 30. Therefore, the feedback signals 42 are able to pass through the filter and gain circuit 30. Other signals transduced by the acoustic sensor 28 are filtered out by the filter and gain circuits 30 thereby preventing false feedback signals from being relayed to the controller 34.

A preferred filter and gain circuit for use in association with a medical monitoring device and alarm includes a Texas Instruments Op Amp having Model No. TLC271CD.

The visual indicator 32 of the redundant alarm system 20 preferably is a light emitting diode (LED) and preferably includes LED drive circuitry for providing a means for controller 34 to control the on/off status of each LED. It will be appreciated that the visual indicator 32 may also include a variety of other conventionally known devices for generating visual signals.

It will be appreciated that the visual indicator 32 of the alarm system 20 can be designed to flash at different rates, with each rate corresponding to a different failure that may occur within the alarm system. For example, if only the primary alarm 24 is inoperative, the visual indicator 32 might flash at a rate of once every five seconds. In contrast, if both the primary audible alarm 24 and the secondary audible alarm 26 are inoperative, the visual indicator 32 may flash at a rate of once per second. Furthermore, the visual indicator 32 may flash at a third rate if the controller 34 detects an non-alarm condition failure of the primary alarm 24, the secondary alarm 26, or the acoustic sensor 28.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is as follows:

1. A redundant alarm system comprising:

a controller;

a primary alarm that interfaces with the controller, the primary alarm being adapted for transmitting an audible first alarm signal upon receipt of a first power-on signal from the controller;

a secondary alarm that interfaces with the controller, the secondary alarm being adapted for transmitting a second alarm signal upon receipt of a second power-on signal from the controller; and an acoustical sensor that interfaces with the controller, the acoustical sensor being adapted for detecting the audible first alarm signal and transmitting a first feedback signal to the controller upon detection of the audible first alarm signal, wherein if the controller does not receive the first feedback signal from the acoustical sensor within a predetermined time after transmitting the first power-on signal to the primary alarm, the controller transmits the second power-on signal to the secondary alarm.

2. The redundant alarm of claim 1, wherein the second alarm signal is audible.

3. The redundant alarm system of claim 2, further including a visual indicator that interfaces with the controller, the visual indicator being adapted for transmitting a visual alarm signal upon activation by the controller, wherein if the controller does not receive the first feedback signal from the acoustical sensor in a predetermined time after transmitting the first power-on signal to the primary alarm, the controller concurrently activates the visual indicator and transmits the second power-on signal to the secondary alarm.

4. The redundant alarm system of claim 3, wherein if the controller receives the first feedback signal from the acoustical sensor and the first power-on signal has not been previously sent to the primary alarm, the controller activates the visual indicator.

5. The redundant alarm of claim 1, wherein the acoustical sensor comprises a microphone.

6. A medical monitoring device comprising:

a controller;

a physiologic sensor that interfaces with the controller, the physiologic sensor being adapted for detecting a physiologic alarm condition in a patient and transmitting a physiologic alarm condition signal to the controller upon detection of the physiologic alarm condition;

a primary alarm that interfaces with the controller, the primary alarm being adapted for transmitting an audible first alarm signal upon receipt of a first power-on signal from the controller;

a secondary alarm that interfaces with the controller, the secondary alarm being adapted for transmitting a second alarm signal upon receipt of a second power-on signal from the controller; and an acoustical sensor for detecting the audible first alarm signal and transmitting a first feedback signal to the controller upon detection of the audible first alarm signal, wherein if the controller does not receive the first feedback signal from the first acoustical sensor within a predetermined time after transmitting the first power-on signal to the primary alarm, the controller transmits the second power-on signal to the secondary alarm such that the secondary alarm is activated.

7. The medical monitor of claim 6, wherein the second alarm signal is audible.

8. The redundant alarm system of claim 7, further including a visual indicator that interfaces with the controller, the visual indicator being adapted for transmitting a visual alarm signal upon activation by the controller, wherein if the controller does not receive the first feedback signal from the acoustical sensor in a predetermined time after transmitting the first power-on signal to the primary alarm, the controller concurrently activates the visual indicator and transmits the second power-on signal to the secondary alarm.

9. The redundant alarm system of claim 8, wherein if the controller receives the first feedback signal from the acoustical sensor and the first power-on signal has not been previously sent to the primary alarm, the controller concurrently activates the visual indicator.

* * * * *